United States Patent [19]

Albert

[11] 4,133,446

[45] Jan. 9, 1979

[54] DRINKING VESSEL COVER WITH VALVE CONTROLLED OPENINGS

[75] Inventor: Kenneth J. Albert, Beverly Hills, Calif.

[73] Assignee: Thermo-Seal, Inc., Los Angeles, Calif.

[21] Appl. No.: 881,384

[22] Filed: Feb. 27, 1978

[51] Int. Cl.[2] ..... A47G 19/22

[52] U.S. Cl. ..... 220/90.4; 222/508; 222/517; 222/518

[58] Field of Search ..... 222/517, 518, 508; 220/254, 255, 90.4

[56] References Cited

U.S. PATENT DOCUMENTS

| | | | |
|---|---|---|---|
| 302,483 | 7/1884 | Haslage | 222/517 X |
| 322,569 | 7/1885 | Tafts | 222/518 X |
| 548,236 | 10/1895 | Stevenson | 222/518 X |
| 2,447,870 | 8/1948 | Polcyn | 220/90.4 |
| 3,964,631 | 6/1976 | Albert | 220/90.4 |
| 3,967,748 | 7/1976 | Albert | 220/90.4 |
| 3,972,443 | 8/1976 | Albert | 220/90.4 |

FOREIGN PATENT DOCUMENTS

| | | | |
|---|---|---|---|
| 16188 of | 1890 | United Kingdom | 222/508 |

*Primary Examiner*—William Price
*Assistant Examiner*—Allan N. Shoap
*Attorney, Agent, or Firm*—Dean, Flickinger & Robertson

[57] ABSTRACT

A cover for a drinking vessel of heat-insulating material comprising a cylindrical wall with elements at its lower end which cooperate with complemental elements at the upper end of a drinking vessel to provide a detachable bayonet joint. Integral with the upper end portion of the cylindrical wall is an inclined flat wall formed with a drinking opening and a relief vent in diametric alignment. Depending from the inclined wall substantially midway between said opening and vent are a pair of spaced lugs each having a journal recess opening onto its lower edge. A lever has a pair of studs extending from its opposite side faces and received in said recesses with snap fits. Upstanding from one end of the lever is an arm which projects through the drinking opening and carries a valve member on its upper end which is of greater extent than said drinking opening and normally engages the upper surface of the inclined wall about the drinking opening. A pushbutton upstands from the other end of the lever and through said relief vent. A gasket is mounted on the pushbutton and engages the lower face of the inclined wall about the relief vent to provide a seal therefor. A U-shaped leaf spring is positioned between the lugs and is interposed between the inclined wall and lever and biases the valve member and gasket into sealing engagement with said inclined wall.

11 Claims, 13 Drawing Figures

DRINKING VESSEL COVER WITH VALVE CONTROLLED OPENINGS

The present invention relates to drinking vessels of heat-insulating material and is concerned primarily with a detachable cover for such a vessel which is formed with a drinking opening and a relief vent in diametric alignment together with a spring-biased pivotally mounted lever having valve members at its opposite ends which cooperate with said opening and vent.

BACKGROUND OF THE INVENTION

At the present time, drinking vessels of the same general type with which the subject invention is concerned are coming into use which is wide-spread and ever-increasing. Such drinking vessels are intended to receive either hot or cold liquids and are of a heat-insulating material. One class of such drinking vessels comprises a circular body having an open top and a removable lid. Vessels of this type are ordinarily discarded after one use. However, there is another class of drinking vessels which are of a construction which provides for their being used repeatedly. The instant invention is intimately related to this latter class.

Such drinking vessels may be characterized as including a circular body which may be either cylindrical or frusto-conical. But in either case, they present open upper ends. Secured to this upper end by a detachable connection is a top or cover consisting of a cylindrical wall and an inclined flat wall formed with a drinking opening adjacent to the periphery of the inclined wall and to which the lips of a user are applied as the contents of the vessel is imbibed.

If a hot liquid such as coffee is contained in the vessel, steam is generated which, if not removed or substantially eliminated, impairs the comfort of the drinker. Most of the cold drinks which would be received in the vessel are carbonated beverages which release carbon dioxide gas which, if not accommodated, will also impair the comfort of the drinker. Inventors, engineers and research workers in this field have recognized the desirability of alleviating the discomfort caused by hot or cold gases but most of these efforts have resulted in the provision of a relief vent in the cylindrical wall of the cover.

Obviously, valve members must be provided to close the drinking opening and the relief vent as the vessel is handled and carried about. Various mechanisms have been devised to maintain these valve members in closed sealing position. Some such mechanisms included lost-motion devices which caused the relief vent to open in advance of the drinking opening. In all such cases, the valve operating devices are highly complicated, difficult to produce in accordance with accepted manufacturing procedures, and therefore are expensive. Moreover, in nearly all of the known devices of this character, two springs are employed for the two valve members. In some instances, a single spring has been used, but this has resulted in uncertainty of operation and requires complex mounting structure for the spring.

While it has been proposed to provide the removable cover of a drinking vessel with a drinking opening and a relief vent, these known vessels are of the disposable type and do not include spring-biased valve members which are associated with the drinking opening and a relief vent in the inclined wall of the vessel cover.

OBJECTS OF THE INVENTION

With the foregoing conditions in mind, the present invention has in view the following objectives:

1. To provide a drinking vessel comprising a circular body and a cover which is detachably secured to the upper end of the body and includes a cylindrical wall and an inclined top wall formed with a drinking opening and a relief vent, together with a pair of valve members for said opening and vent which are spring-biased into closing position.

2. To provide, in a drinking vessel of the type noted, a detachable connection between the cover and the body which takes the form of a bayonet joint.

3. To provide, in a drinking vessel cover of the character aforesaid, a drinking opening in the inclined wall which is closely adjacent to the periphery thereof and a relief vent in diametric alignment with said drinking opening.

4. To provide, in a drinking vessel cover of the kind described, a lever which carries the valve members at the opposite ends thereof and which lever is pivotally mounted between the opening and vent.

5. To provide, in a drinking vessel cover of the type noted, a valve member for the drinking opening which is of greater extent than the drinking opening and which engages the upper surface of the inclined wall about the drinking opening when the valve member is in closed position.

6. To provide a drinking vessel cover of the character aforesaid in which the valve member for the relief vent takes the form of a pushbutton on the end of the lever remote from that carrying the drinking valve opening, with the pushbutton normally projecting through the relief vent and having a gasket mounted thereon which engages the underside of the inclined wall to close the relief vent.

7. To provide, in a drinking vessel cover of the kind described, a pivotal mounting for the lever in the form of a pair of spaced lugs depending from the underside of the inclined wall, with each lug having a journal recess which opens onto the lower edge of the lug and receives one of a pair of studs outstanding from the side faces of the lever.

8. To provide, in a drinking vessel cover of the type noted, a leaf spring which engages the inclined wall and the lever to bias the drinking opening valve and pushbutton valve into closed position.

9. To provide, in a drinking vessel cover of the character aforesaid, various embodiments of the valve member for the drinking opening.

Various other more detailed objects and advantages of the invention such as arise in connection with carrying out the above-noted ideas in a practical embodiment will in part become apparent and in part be hereinafter stated as the description of the invention proceeds.

SUMMARY OF THE INVENTION

The foregoing objects are achieved by providing a drinking vessel of a heat-insulating material and including a body in the form of a circular wall presenting an open top with elements of a bayonet joint formed integral with the circular wall and outstanding therefrom.

A cover is detachably secured to the body by complemental elements of the bayonet joint which are formed on a ring that is spaced from a cylindrical wall at the lower end of the latter. Integral with the cylindrical wall and adjacent to the upper edge thereof is an inclined flat wall having a circular drinking opening formed therein adjacent to its periphery and a relief vent in diametric alignment with the drinking opening in opposed relation relative thereto.

Depending from the underside of the inclined wall are a pair of spaced lugs each of which is formed with a journal recess opening onto the lower edge thereof. These lugs are located substantially midway between the drinking opening and the relief vent. A lever has a pair of studs outstanding from the opposite side surfaces thereof which are received in the recesses in the studs with snap fits with the lugs and studs providing a pivotal mounting for the lever.

Upstanding from one end of the lever is an arm which projects through the drinking opening and is formed with a valve member on its free end and which is located above the upper surface of said inclined wall. This valve member takes the form of a disk which is of greater extent than the circular drinking opening and engages the upper face of the inclined wall when it is in closed position.

Upstanding from the other end of the lever is another valve member in the form of a pushbutton which projects through the vent and has a gasket mounted thereon which engages the underside of the inclined wall to close the vent. A U-shaped leaf spring is positioned between the lugs with one leg of the spring engaging the underside of the inclined wall and the other leg, the upper edge of the lever. This spring biases the valve members for the drinking opening and relief vent into closed position. It is evident that by exerting a downward pressure on the pushbutton, the lever is rotated about its pivotal mounting to open the relief vent and the drinking opening.

The valve member for the drinking opening may take any of several forms, all of which are designed to provide an effective seal when the valve member is in closed position.

For a full and more complete understanding of the invention, reference may be had to the following description and accompanying drawings wherein.

DESCRIPTION OF A PREFERRED EMBODIMENT

Figure 1:
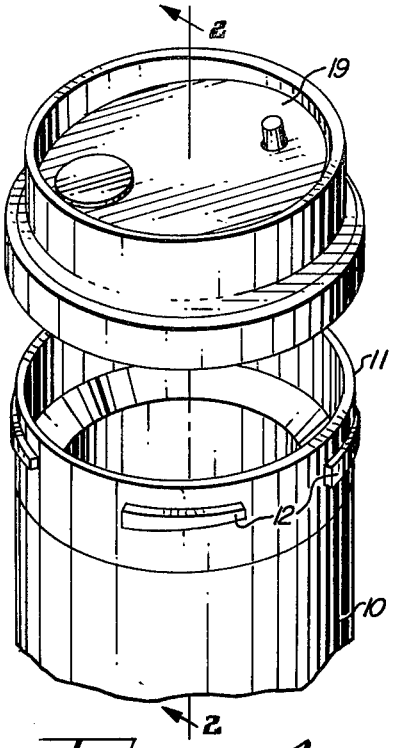
FIG. 1 is a perspective depicting in exploded relation the upper portion of the body of a drinking vessel and the cover therefor.

Referring now to the drawings, wherein like reference characters denote corresponding elements throughout the several views, and first more particularly to FIGS. 1–4, inclusive, a portion of a cylindrical wall of a drinking vessel is designated 10. It may be of any of the heat-insulating materials now available and commonly known to those familiar with the art of drinking vessels. Cylindrical wall 10 presents an upper edge 11 which defines an open top. Formed integrally with the circular wall 10 just below edge 11 are a plurality of equi-distantly spaced cam lugs 12 which constitute elements of a bayonet joint.

A cover for the open top of cylindrical wall 10 is identified in its entirety by the reference charcter 13. Cover 13 comprises a cylindrical wall 14 which also is of a heat-insulating material, and formed integrally therewith and outstanding therefrom is an annular flange 15. Depending from the outer edge of flange 15 is a ring 16 which may be secured to the outer edge of flange 15 in any preferred manner such as by fusing the plastic materials of which these elements are made. Projecting inwardly from the ring 16 at its lower edge are a plurality of equi-distantly spaced cam ribs 17. These cam ribs 17 are complemental to the cam lugs 12 in that they are dimensioned to be passed between confronting ends of the lugs 12 and, upon rotation of cover 13, tighten the latter on the upper edge 11 of body 10. A packing member 18 is positioned on the underside of flange 15 and is engaged by edge 11 to achieve a fluid-tight seal of cover 13 with respect to cylindrical wall 10. Formed integrally with cylindrical wall 14 and adjacent to its upper edge is a flat wall 19 which is inclined relative to the axis of cylindrical wall 14. Wall 19 is formed with a circular drinking opening 20 which is located adjacent to the periphery of wall 19 and at the zone which is spaced the greatest distance from the upper edge of wall 14. Wall 20 is also formed with a circular relief vent 21 which is diametrically opposed to and in alignment with drinking opening 20. It is located at the area of wall 19 which is closest to the upper edge of cylindrical wall 14. Stating it another way, drinking opening 20 is at the lowest point of inclined wall 19 and relief vent 21 adjacent to the highest point of wall 19.

Figure 3:
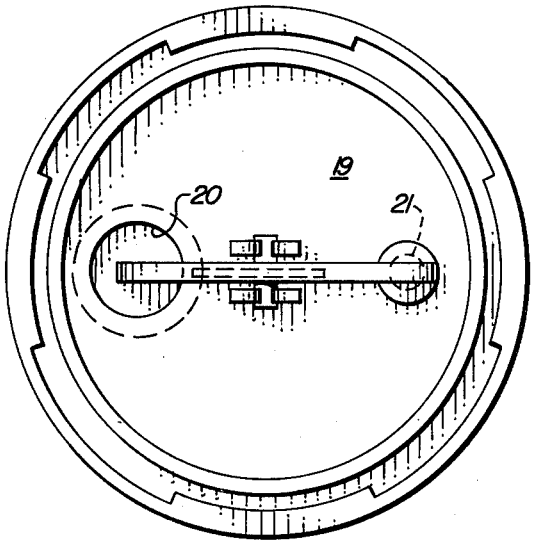
FIG. 3 is a bottom plan view of the cover per se, being taken on the plane of the line 3—3 of FIG. 2.
Figure 4:
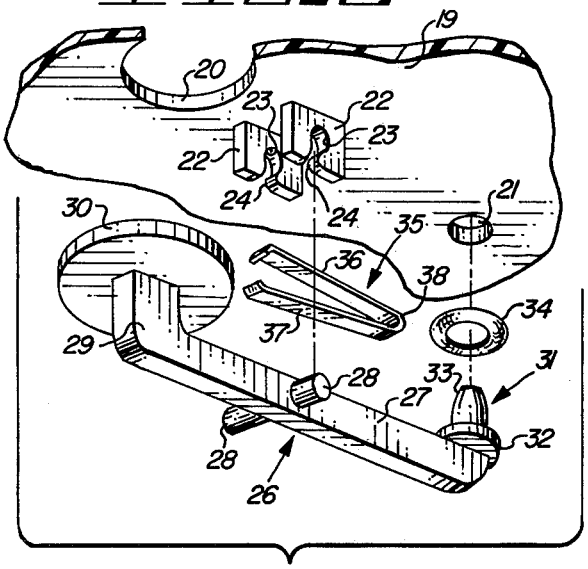
FIG. 4 is a perspective illustrating the elements of the valve mechanism in exploded relation.

Referring now more particularly to FIGS. 3 and 4, a pair of lugs 22 depend from the underside of flat wall 19 in spaced relation relative to each other and substantially midway between opening 20 and vent 21. These lugs 22 are preferably formed integrally with flat wall 19. Each lug 22 is formed with a so-called journal recess 23 which has a narrow neck 24 which opens onto the lower edge 25 of the lug. These lugs 22, together with the recesses 23 therein, constitute one-half of the pivotal mounting of a lever designated generally 26.

Lever 26 is also preferably of plastic and takes the form of a bar having side faces 27 from each of which projects a stud 28 which is formed integrally with the lever 26. These studs 28 are received in recesses 23 with a snap fit engendered by forcing them through the necks 24 of the recesses 23. Thus, the studs 28 constitute the other one-half of the pivotal mounting for lever 26. These studs 26 are located substantially midway between the opposite ends of lever 26.

Figure 2:
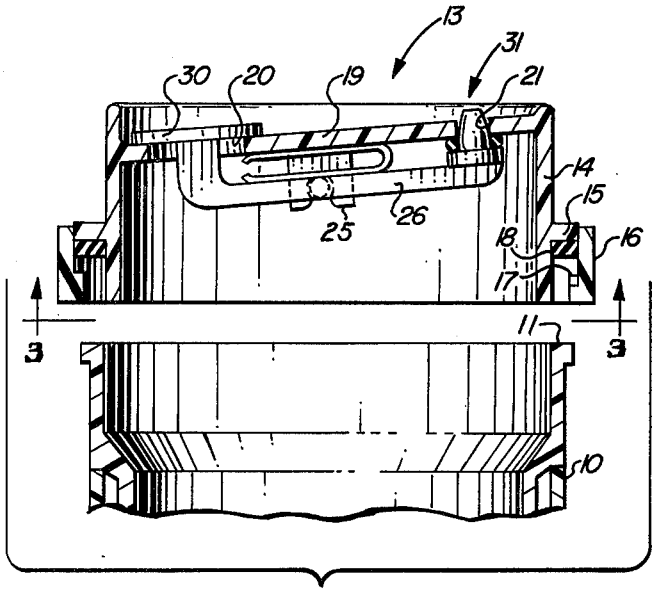
FIG. 2 is a vertical section through the upper portion of the drinking vessel body and the cover, being taken about on the plane represented by the line 2—2 of FIG. 1.

Upstanding from one end of lever 26 and formed integrally therewith is a stub arm 29 which is dimensioned to pass through drinking opening 20 and beyond the upper surface of flat wall 19. Formed integrally with the upper end of stub arm 29 is a valve member 30 in the form of a disk which is of greater extent than drinking opening 20 whereby it engages the upper surface of flat wall 19 when the valve member is in position closing opening 20 as depicted in FIG. 2. Upstanding from the other end of lever 26 is a valve member designated generally 31 and which comprises a disk 32 of greater extent than vent 21 and a pushbutton 33 which passes through vent 21 and projects above the upper surface of inclined wall 19. A gasket 34 is included as a part of valve member 31 and is positioned above pushbutton 33 and in engagement with disk 32.

A U-shaped leaf spring is referred to in its entirety at 35. It comprises an upper leg 36 and a lower leg 37, with the legs 36 and 37 being connected by a bend 38. Spring 35 is positioned between the lugs 22 with the leg 36 engaging the underface of inclined wall 19 and the leg 37, the upper edge of lever 26. Thus spring 35 biases lever 26 in a counterclockwise direction, speaking with reference to the showing of FIG. 2. Therefore, valve member 30 is urged into position closing drinking opening 20 and valve member 31 into position closing relief vent 21.

OPERATION

While the manner of using and operating the drinking vessel cover illustrated in FIGS. 1–4, inclusive, are believed to be obvious from the illustrations of the drawings and description of parts set forth above, they may be briefly described as follows.

With cover 13 removed from the vessel body, the latter may be filled with a desired liquid, either hot or cold. Cover 13 is then positioned to close the open top defined by edge 11 by passing the cam ribs 17 through the spaces between cam lugs 12 and rotating the cover 13 relative to body 10 to tighten packing 16 against upper edge 11. The filled vessel may then be carried about from place to place with drinking opening 20 and relief vent 21 closed by the valve members therefor which are biased into closed position by spring 35. When a user is desirous of imbibing the contents of the vessel, the latter is positioned so that drinking opening 20 is disposed closely adjacent to the lips of the drinker. A downward pressure is then applied to pushbutton 33 which rotates the lever 26 in a clockwise direction against the influence of spring 35. This movement brings the valve members 30 and 31 into positions opening drinking opening 20 and relief vent 21. Thus, it is evident that steam from a hot beverage such as coffee or gas from a carbonated drink is exhausted through relief vent 21 while the liquid contents are sipped through opening 20.

The snap fit of each stud 28 in a recess 23 is of great practical importance because it provides for the disassembly of the lever 26 from its pivotal mounting which, in turn, permits removal of spring 35 should it become weakened or broken and it is replaced by a new spring. This ability to disassemble the lever 26 also provides for replacement of gasket 34.

THE MODIFICATIONS

Figure 5:
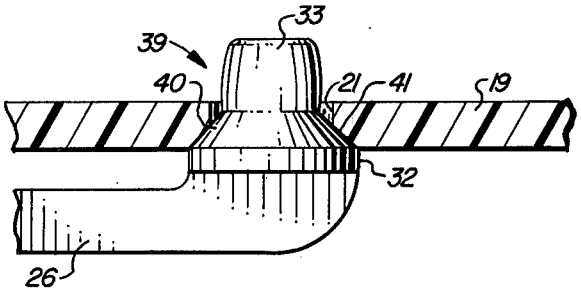
FIG. 5 is a view on an enlarged scale of a modified embodiment of the pushbutton valve with a portion of the inclined wall shown in section and an end portion of the lever in elevation.

Valve members 30 and 31 may take several different forms, some of which are illustrated and hereinafter described in detail. Thus, referring to FIG. 5, valve member 31 is replaced by a modified form of valve member designated generally 39. It comprises disk 32 and a frusto-conical portion 40 which engages the lower portion of relief vent 21 which is formed with a frusto-conical surface 41. It also includes the usual pushbutton 33.

Figure 6A:
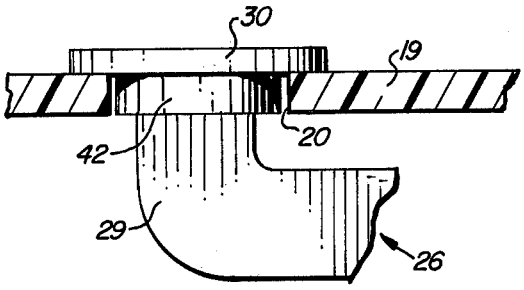
FIG. 6A is another view on an enlarged scale partly in section and partly in elevation of a modified embodiment of the valve member for the drinking opening.
Figure 6B:
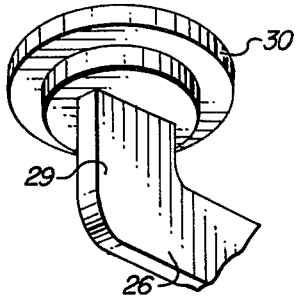
FIG. 6B is a detailed perspective of the valve member of FIG. 6A.

Referring now more particularly to FIGS. 6A and 6B, stud arm 29 has a disk 42 formed integrally with the upper end thereof and of a size slightly less than opening 20. Valve disk 30 is formed integral with disk 42.

Figure 7A:
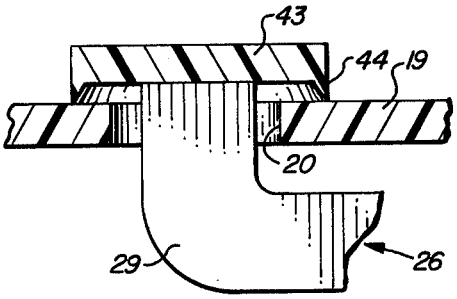
FIG. 7A is another view on an enlarged scale similar to FIG. 6A illustrating another embodiment of the valve member for the drinking opening.
Figure 7B:
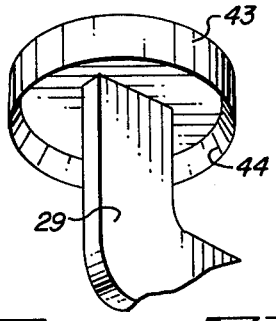
FIG. 7B is a detailed perspective of the valve member of FIG. 7A.

Referring now more particularly to FIGS. 7A and 7B, valve member 30 is replaced by a disk 43 formed integrally with the upper end of stud arm 29 and which is formed with a knife edge 44 at its periphery which bites into flat wall 19.

Figure 8A:
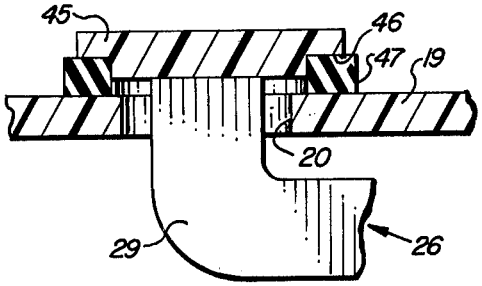
FIG. 8A is a view similar to FIGS. 6A and 7A of another modification of the valve member for the drinking opening.
Figure 8B:
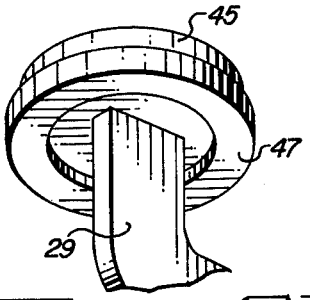
FIG. 8B is a detailed perspective of the valve member of FIG. 8A.

FIGS. 8A and 8B disclose an arrangement in which valve member 30 is replaced by another form of valve disk depicted at 45 which is formed with an annular notch 46 at its lower peripheral corner and which receives a portion of a packing ring 47 which is rectangular in cross-section.

Figure 9A:
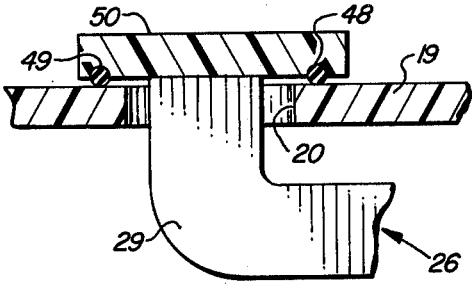
FIG. 9A is a view similar to FIGS. 6A, 7A and 8A of still another modification of the valve member for the drinking opening.
Figure 9B:
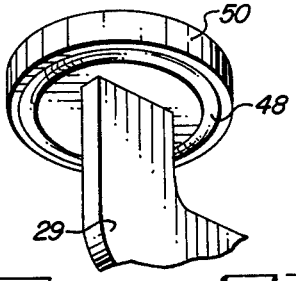
FIG. 9B is a detailed perspective of the valve member of FIG. 9A.

FIGS. 9A and 9B disclose a final modification which is generally the same as FIGS. 8A and 8B with the notable exception that packing ring 47 is replaced by an O-ring 48 which is received in an annular groove 49 formed in the lower face of a valve disk 50 adjacent to the periphery thereof.

While preferred specific embodiments of the invention are hereinbefore set forth, it is to be clearly understood that the invention is not to be limited to the exact constructions, mechanisms and designs illustrated and described because various modifications of these details may be provided in putting the invention into practice.

What is claimed is:

1. In a cover of heat-insulating material intended for detachable connection to a drinking vessel having a body of heat-insulating material and including a cylindrical wall having an upper edge defining an open top:

(a) a cylindrical wall having a lower end portion;

(b) means for detachably securing the lower end portion of said cylindrical wall to the cylindrical wall of said body;

(c) an inclined flat wall integral with said cylindrical wall adjacent to the upper edge thereof and presenting a zone of maximum depth and an area of minimum depth, speaking with reference to the upper edge of said cylindrical wall;

(d) a drinking opening formed in said inclined wall in said zone of maximum depth;

(e) a relief vent formed in said inclined wall at said area of minimum depth and diametrically opposed to said drinking opening;

(f) a lever spaced from and pivotally mounted on the underface of said inclined wall substantially midway between said drinking opening and said relief vent;

(g) a stub arm integral with and upstanding from one end of said lever, and extending through said drinking opening;

(h) a valve member integral with said arm and of an extent greater than said drinking opening whereby said valve member engages the upper surface of said inclined flat wall when in position closing said drinking opening;

(i) another valve member integral with and upstanding from the other end of said lever and including a pushbutton passing through said relief vent and extending above the upper surface of said inclined wall, said last-mentioned valve member having a portion engaging the underside of said inclined wall to close said relief vent; and (j) a spring interposed between said inclined wall and said lever and normally biasing said lever to move said valve members into position closing said drinking opening and said relief vent;

(k) whereby downward movement of said last-mentioned valve member opens said relief vent and further causes upward movement of the first-mentioned valve member to open said drinking opening.

2. The drinking vessel cover of claim 1 in which said drinking opening is circular and the valve member therefor takes the form of a disk of greater extent than said circular opening.

3. The drinking vessel cover of claim 2 in which the valve member for said drinking opening comprises a disk integral with the adjacent stub arm and of a diameter smaller than said drinking opening in which it is received when the valve is in closed position and a valve disk of greater diameter than said drinking opening.

4. The drinking vessel cover of claim 2 in which the valve member for the drinking opening is formed with an annular lip projecting from its lower face at the periphery thereof and which presents a knife edge which bites into said flat wall when the valve member is in position closing said drinking opening.

5. The drinking vessel cover of claim 2 in which said valve member is formed with an annular notch at the lower corner of its periphery, together with a packing ring of rectangular cross-section which is received in said notch and which engages the upper surface of said inclined wall when the valve member is in position closing said drinking opening.

6. The drinking vessel cover of claim 2 in which the valve member for the drinking opening is formed on its lower face with an annular groove of a diameter greater than that of said drinking opening, together with an O-ring received in said groove and engaging the upper face of said flat wall when the valve member is in position closing said drinking opening.

7. The drinking vessel cover of claim 1 in which the relief vent is circular and the valve member for said relief vent takes the form of a gasket mounted on said pushbutton.

8. The drinking vessel cover of claim 1 in which the pivotal mounting for the lever comprises a pair of spaced lugs depending from the underside of said flat plate and located substantially midway between said drinking opening and said relief vent, each of said lugs being formed with a journal recess together with a pair of studs outstanding from opposite sides of said lever and received in said journal recesses with snap fits.

9. The drinking vessel cover of claim 8 in which said spring takes the form of a leaf spring comprising two legs connected by a bend with one of said legs bearing against the underside of said flat wall and the other of said legs engaging said lever.

10. The drinking vessel cover of claim 1 in which the means for detachably securing the cover to the body of the drinking vessel comprises complemental elements of a bayonet joint on the cylindrical walls of said cover and drinking vessel body.

11. The drinking vessel cover of claim 1 in which the relief vent has a lower portion formed as a frusto-conical surface and the valve member therefor comprises a disk formed integrally with the end of the lever which carries this valve member, a frusto-conical portion integral with said disk and adapted to be snugly seated in the conical portion of said relief vent, and a pushbutton extending upwardly from said frusto-conical portion.

* * * * *